US005282606A

United States Patent [19]

Praiss

[11] Patent Number: 5,282,606

[45] Date of Patent: Feb. 1, 1994

[54] RECONFIGURABLE SAFETY FENCE

[76] Inventor: Arthur V. Praiss, 1940 N.W. 18th St., Pompano Beach, Fla. 33069

[21] Appl. No.: 990,953

[22] Filed: Dec. 17, 1992

[51] Int. Cl.[5] ..... E04H 17/00

[52] U.S. Cl. ..... 256/26; 256/24; 160/135

[58] Field of Search ..... 256/24–26, 256/73; 52/71, 239; 160/135, 233, 234, 351

[56] References Cited

U.S. PATENT DOCUMENTS

| | | | |
|---|---|---|---|
| 179,519 | 7/1876 | Cameron | 256/25 |
| 3,471,129 | 10/1969 | Mpakarakes | 256/25 |
| 3,534,512 | 10/1970 | Ballas | 52/71 |
| 4,537,151 | 8/1985 | Bolton | 256/25 |
| 5,161,784 | 11/1992 | Sader | 256/25 |

FOREIGN PATENT DOCUMENTS

| | | | |
|---|---|---|---|
| 276995 | 12/1969 | Austria | 52/71 |
| 615042 | 12/1926 | France | 256/25 |

*Primary Examiner*—Randolph A. Reese
*Assistant Examiner*—Anthony Knight
*Attorney, Agent, or Firm*—M. K. Silverman

[57] ABSTRACT

A reconfigurable safety fence system for disposition relative to a fixed plane or area of reference includes a plurality of panels, each panel having a central vertical post including a swivel-mounted wheel at a lower base and, essentially symmetrically about an axis defined by the central post, respective upper and lower horizontal, and left and right vertical, perimeters of each of the panels, including vertical picket elements between the horizontal perimeters, each of the vertical perimeters including hinge elements for rotational movement and securement of each panel relative to that panel adjacent thereto about a vertical axis of each of the hinge elements in which a first vertical perimeter of a first of the panels of the system is secured to the area of reference.

2 Claims, 5 Drawing Sheets

RECONFIGURABLE SAFETY FENCE

BACKGROUND OF THE INVENTION

The present invention addresses a long-standing need for a means of selectively providing, about a potentially hazardous area such as an in ground pool, a security perimeter, in the nature of a fence, that would render difficult or impossible the entry by a child or pet to the immediate perimeter of the pool.

While it is commonplace for in-ground pools to be surrounded by fixed-position fences which can be positively locked to prevent access thereto, many owners of property having such pools are hesitant to install such permanent fixed position structures on their property for a variety of reasons, these ranging from the aesthetic to the practical, namely, upon many properties in which an in-ground pool has been installed the permanent residents of the dwelling upon such property are of an age such that it is not necessary, for any safety reason, to provide a permanent security perimeter about the pool. However, as is commonplace, visitors to such households may include smaller children and pets so that, during such visits, different safety and security needs, relative to the pool will exist. The instant invention is, therefore, adapted to situations in which the need does not necessarily exist for a permanent fence structure near or about an in-ground pool but, rather, in situations that will arise only occasionally such as a visit from friends or family having smaller children or pet.

With regard to that prior art known to the inventors herein, the use of configurable fences, in various forms, has been known in the animal husbandry arts for many years where, for example, it is necessary to separate groups of animals of one type from animals not of that type or to provide direction, on a selectably basis, for movement of such animals within pens or the like. To the knowledge of the inventors, such prior art, as it is known in the area of animal husbandry, does not afford a structure having suitable flexibility and range of reconfiguration as does the system set forth herein. As well, the respective areas of application are non-analogous to each other.

SUMMARY OF THE INVENTION

The present invention relates to a reconfigurable safety fence system for disposition relative to a fixed plane or area of reference. The fence system comprises a plurality of panels, each panel comprising a central vertical post having a swivel-mounted wheel at a lower base thereof and, essentially symmetrically about an axis defined by said vertical post, respective upper and lower horizontal, and left and right vertical, perimeters of each of said panels, including vertical picket elements between said horizontal perimeters, each of said vertical perimeters including hinge means for rotational movement and securement of each panel relative to that panel adjacent thereto about a vertical axis of each of said hinge means, in which a first vertical perimeter of a first of said panels of said system is secured to said plane of reference.

It is, accordingly, an object of the present invention to provide a reconfigurable safety fence particularly adapted for creating, about a potentially hazardous location such as an inground pool, a safety perimeter to preclude undesired access to such a hazardous location.

It is another object of the invention to provide a safety fence which may be used to limit access from one area of a property to another.

It is a further object of the instant invention to provide a reconfigurable safety fence structure which may, when not in use, be collapsed into a reduced volume.

It is a yet further object of the invention to provide a safety fence of the above type that may be configured into a multiplicity of different geometries.

It is a still further object to provide a safety fence of the above type in which two or more of such fences may be used in combination to enhance the length of a security perimeter that may be effected with such safety fences.

The above and yet other objects and advantages of the present invention will become apparent from the hereinafter set forth Brief Description of the Drawings, Detailed Description of the Invention, and Claims appended herewith.

DETAILED DESCRIPTION OF THE INVENTION

Figure 1:
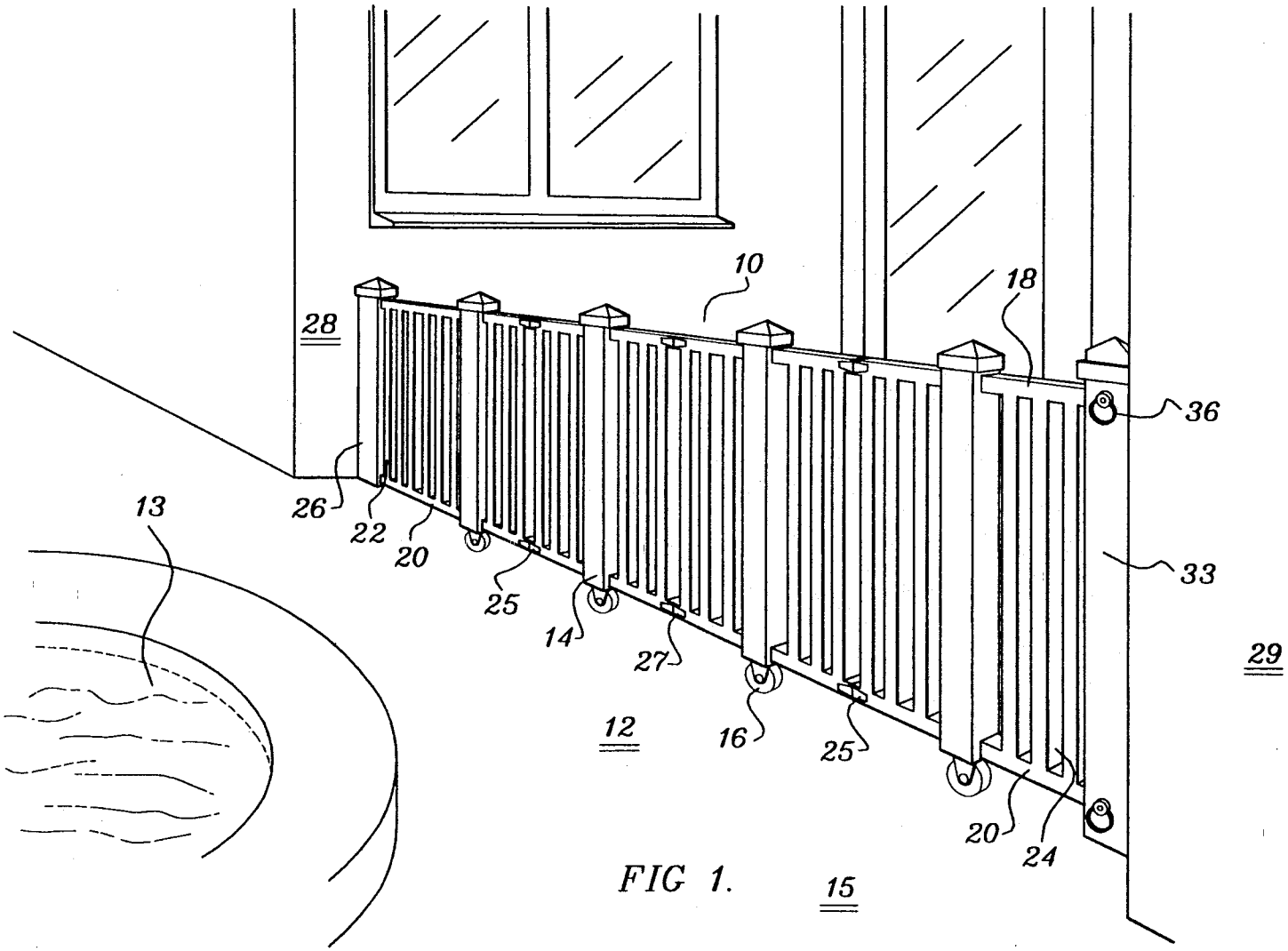
FIG. 1 is a perspective view showing usage of the inventive safety fence system in a linear fashion to block a single direction area of access to an in-ground pool.
Figure 2:
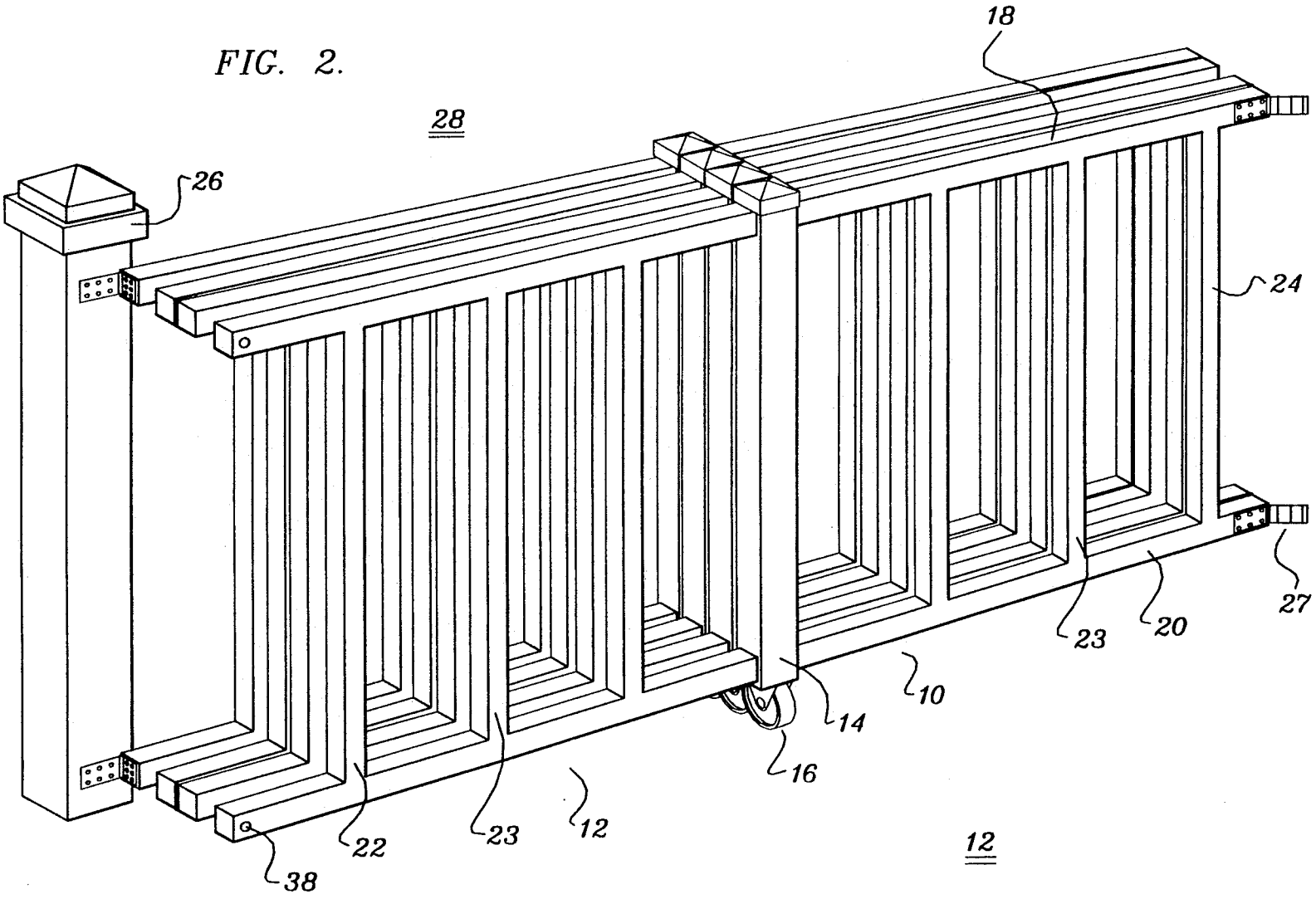
FIG. 2 is a perspective view showing the system of FIG. 1 in a retracted, folded-up mode.

With reference to the views of FIGS. 1 and 2, the instant inventive reconfigurable safety fence system may be seen to consist of a plurality of panels 10 which are oriented vertically relative to the ground or property surface 12. Each of said panels include a vertical central post 14 and, at the lower base thereof, a swivel-mounted wheel 16. This feature defines an essential aspect of functionality of the present invention.

Figure 3:
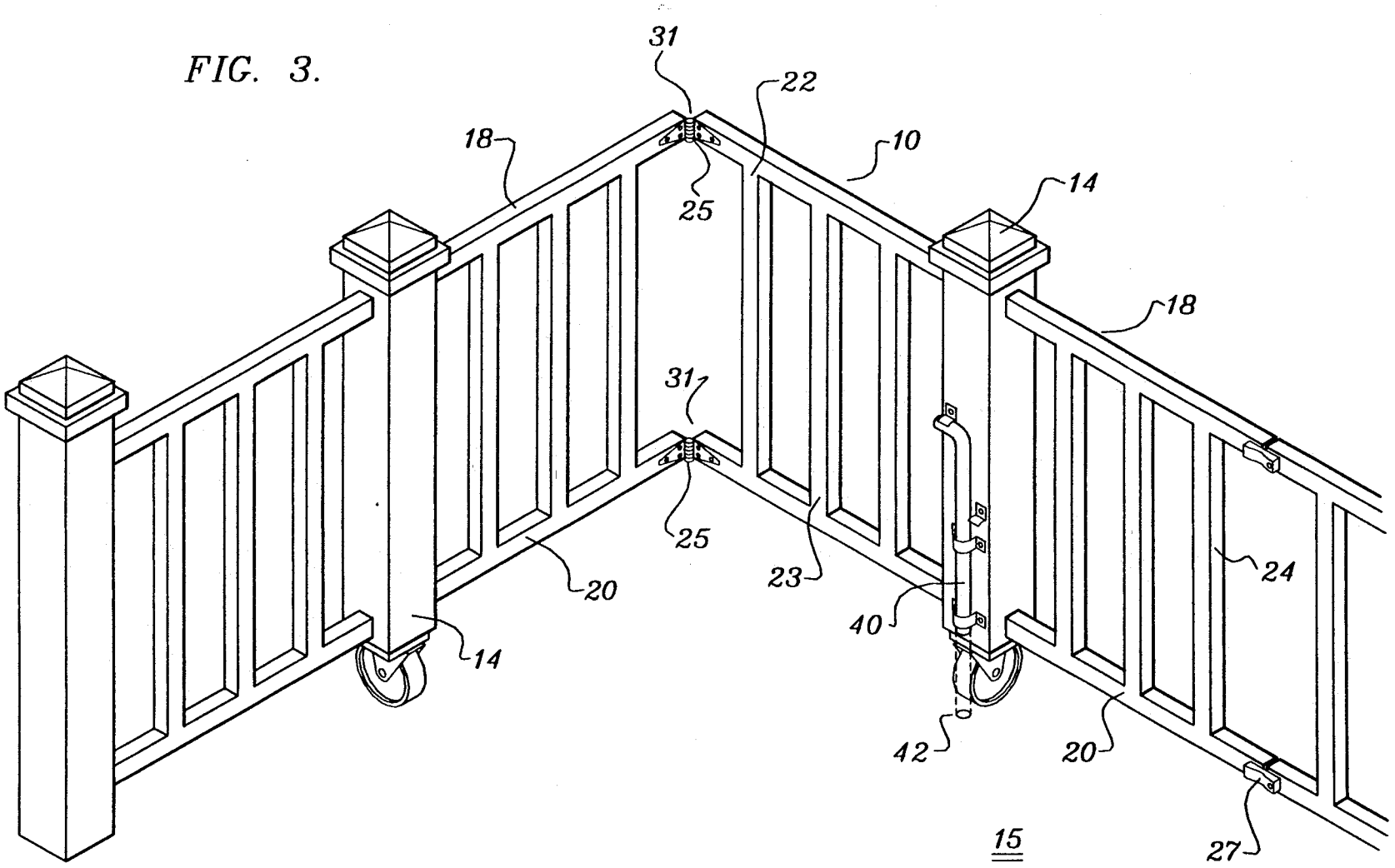
FIG. 3 is a perspective view of the inventive fence system fence showing it configured into a right angular geometry.

As may be more particularly seen in FIGS. 2 and 3, each panel 10 includes, in addition to said vertical post 14, an upper horizontal perimeter 18 and a lower horizontal perimeter 20, each of such perimeters extending integrally outwardly and essentially symmetrically about said vertical post 14. As may be further noted in FIGS. 2 and 3, each panel 10 also includes a left vertical perimeter 22 and a right vertical perimeter 24 which are situated essentially symmetrically relative to said central post 14. Between the vertical perimeters 22 and 24 there may be provided a plurality of vertical picket elements 23, the exact number of which is not critical to the practice of the instant invention.

As may be noted in the views of FIGS. 1 and 3, each panel 10 is rotatably secured to a like adjacent panel by means of hinge means 25 and locking means 27. As may be noted in FIGS. 3 and 4, said means 25 and 27 are alternated upon one side of the fence system and, upon each opposing edge thereof, a hinge means of the opposite type is employed. Accordingly, it may be seen that combinations of respectively smaller hinge means 25 and larger locking means 27 are used to create rotatable interfaces between respective panels 10.

Figure 4:
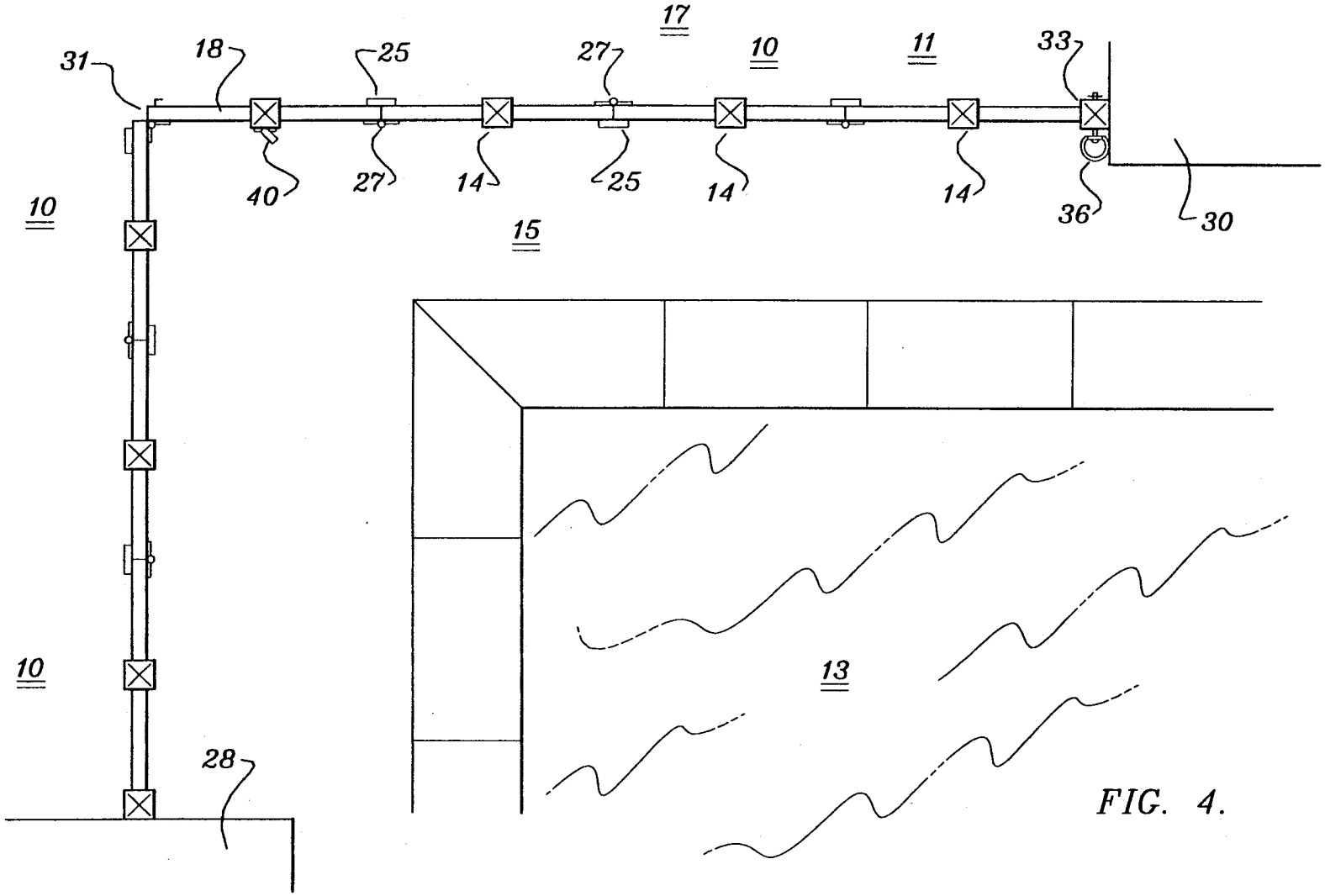
FIG. 4 is a top view of the system in the configuration of FIG. 3, however, extended to provide a security perimeter about a corner of a large pool and between two sides of a house near said pool.

Further, where a right angle connection is desired, as in the case in the situation shown in FIGS. 3 and 4, an angle bracket 31 may be complementally locked onto both the upper and lower horizontal perimeters 18 and 20 of adjacent panels 10.

As may be noted in the views of FIGS. 1 and 4, the inventive safety fence may be employed in a completely linear fashion to preclude access to a pool 13 which would normally occur by walking between walls 28 and 29. In this application of the invention, there are provided special end posts 26 and 33 respectively which are rigidly connected to upper and lower horizontal perimeters 18 and 20 and beyond respective vertical perimeters 22 and 24 to interface with said walls 28 and 29 of the dwelling. In this configuration, said special end post 33 is provided with a cotter pin at the bottom and top thereof so to effect positive connection with upper and lower horizontal perimeters 18 and 20 of the righthandmost panel 10 of the fence system. When use of the fence in the configuration of FIG. 1 is not desired, said cotter pins 36 are simply removed from special end post 33 and the system is then folded-up, against wall 28, in the manner shown in FIG. 2. Further shown in FIG. 2 are holes 38 within which said cotter pins 36 are fit.

In FIG. 3 is shown an application of the instant invention in which one of the panels 10 is secured at a right angle relative to the other. In such a configuration, the above described angle iron 31 is employed. In addition, a vertical rod 40, upon one of said central posts 14, is employed such that, at the lower end thereof, it is complementally lodged within a vertical hole 42 in surface 15 which, as may be noted in FIG. 4, is the protected area immediately adjoining pool 13. Accordingly, though the use of (a) angle iron 31 in secured relationship relative to upper and lower horizontal perimeters 18 and 20, and (b) movable vertical rod 40 in secured relationship relative to vertical hole 42 within, what is typically a concrete surface, both the configurational and orientational stability of the fence system is assured.

In FIG. 4 is shown the use of the segment of FIG. 3 in the context of a larger system to provide a security perimeter to a corner region of a larger pool between sections 28 and 30 of a given dwelling. Also shown in FIG. 4 is the use of said vertical rod 40 and said cotter pins to secure an end panel 11 relative to special end post 33.

Figure 5:
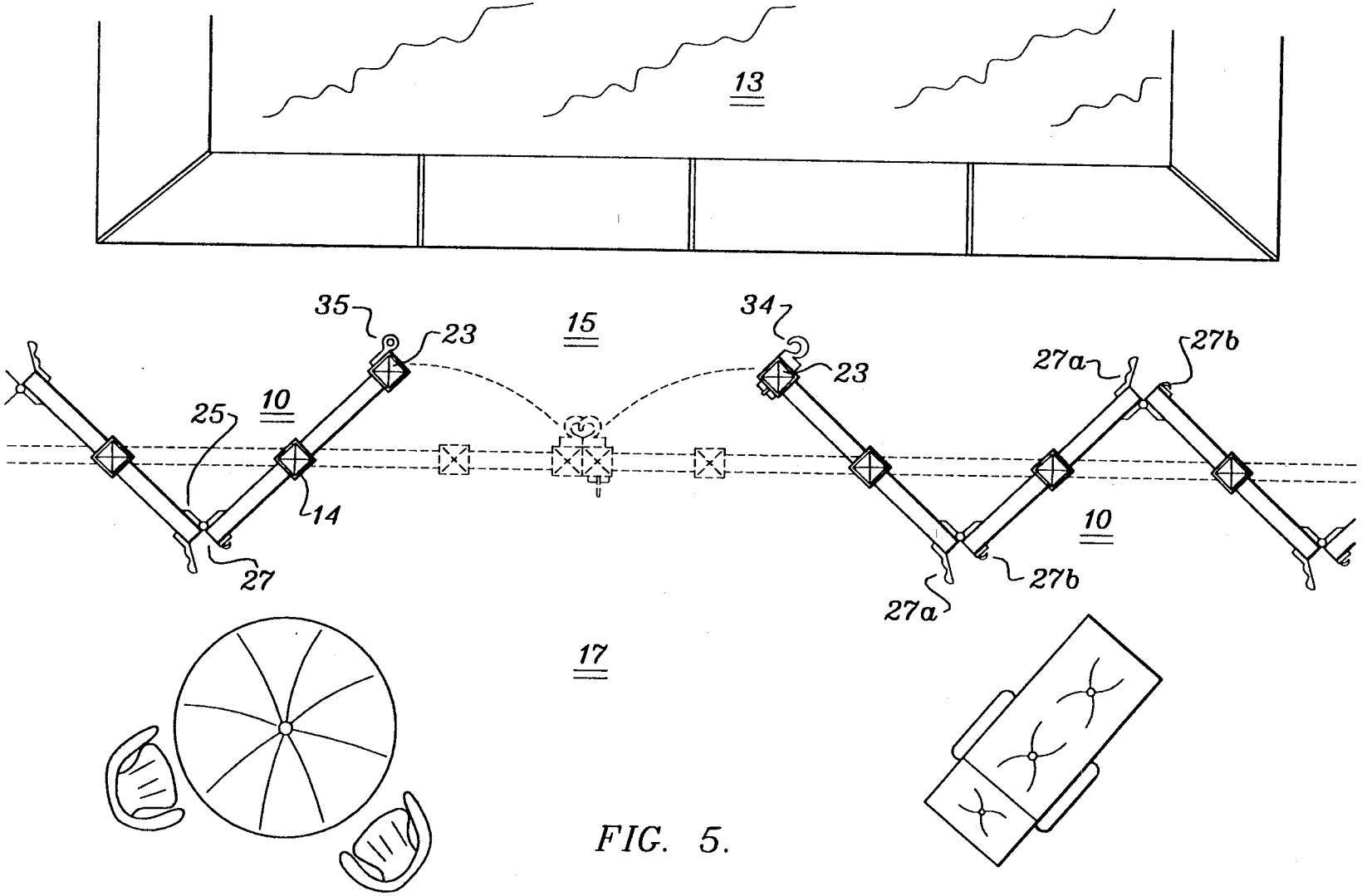
FIG. 5 is a top view showing the use of the fence system in combination with other like systems and also showing the potential range of foldability thereof.

With reference to FIG. 5 there is shown an application of the instant inventive safety fence system in which a plurality of separate fence systems are employed in combination with each other. A first configuration of the respective fence segments is shown in solid line, while a second configuration thereof is shown in dotted line. Thereby, it is to be appreciated that locking means 27 may be advantageously employed to achieve any ultimate geometry which is desired. Also, locking means 34 and 35 in connection to custom vertical posts 23 may be employed to achieve geometries such as that shown in FIG. 5, using separate fence systems.

It is also noted in FIG. 5 that said locking means 27, by which the respective panels 10 are joined, is a specialized element. More particularly, whole hinge means 25 is a conventional hinge having two respectively moveable elements, locking means 27 is a two-element piece including elements **27*a* and 27*b*. Thereby, the angulation of securement between such elements 27*a* and 27*b* and, thereby, of adjacent panels 10 may be controlled. Thereby, it is to be appreciated that essentially any angulation of one panel 10** relative to its adjacent panel may thereby be accomplished within the scope of the present invention.

Accordingly, while there has been shown and described a preferred embodiment of the present invention it is to be appreciated that the invention may be embodied otherwise than is herein specially shown and described and, within such embodiments, certain changes may be made in the form and arrangement of the parts without departing from the underlying ideas or principles of this invention within the scope of the claims appended herewith.

Having thus described my invention what I claim as new, useful and non-obvious and, accordingly, secure by Letters Patent of the United States is:

1. A reconfigurable safety fence system for disposition relative to a fixed structure to define a security perimeter proximal to a hazardous area, the system comprising:

a plurality of panels, each comprising a central vertical post having a swivel-mounted wheel at a lower base thereof and, essentially symmetrically about an axis defined by said central post, respective upper and lower horizontal, and left and right vertical, perimeters for each of said plurality of panels, each panel including vertical picket elements between said horizontal perimeters, each of said vertical perimeters including longitudinal hinge means for rotational movement and securement of each panel relative to an opposing vertical perimeter of that panel adjacent thereto, about a vertical axis defined by each of said hinge means, in which a first vertical perimeter of a first of said panels is secured to said fixed structure.

2. The reconfigurable safety fence system as recited in claim 1, in which said hinge means of said opposing vertical perimeters further includes:

means for selectably locking said hinge means at angles defined by virtual intersections of planes of adjacent panels.

* * * * *